US007086486B2

(12) United States Patent
Ravensbergen et al.

(10) Patent No.: US 7,086,486 B2
(45) Date of Patent: Aug. 8, 2006

(54) FLOW CONTROL VALVE AND METHOD OF CONTROLLING ROTATION IN A DOWNHOLE TOOL

(75) Inventors: John Edward Ravensbergen, De Winton (CA); Don Pike, Airdrie (CA); Doug Brunskill, Calgary (CA)

(73) Assignee: BJ Services Company, Houston, TX (US)

( * ) Notice: Subject to any disclaimer, the term of this patent is extended or adjusted under 35 U.S.C. 154(b) by 138 days.

(21) Appl. No.: 10/773,466

(22) Filed: Feb. 5, 2004

(65) Prior Publication Data

US 2005/0173157 A1 Aug. 11, 2005

(51) Int. Cl.
*E21B 4/02* (2006.01)

(52) U.S. Cl. ..... 175/107

(58) Field of Classification Search ..... 175/50, 175/107; 166/381
See application file for complete search history.

(56) References Cited

U.S. PATENT DOCUMENTS

| | | | | |
|---|---|---|---|---|
| 2,963,099 | A | 12/1960 | Gianelloni, Jr. | 175/25 |
| 3,194,325 | A * | 7/1965 | Gianelloni, Jr. | 175/107 |
| 3,802,515 | A | 4/1974 | Flamand et al. | 173/12 |
| 4,396,071 | A * | 8/1983 | Stephens | 175/50 |
| 4,768,598 | A * | 9/1988 | Reinhardt | 175/107 |
| 6,202,762 | B1 * | 3/2001 | Fehr et al. | 175/107 |
| 6,289,998 | B1 * | 9/2001 | Krueger et al. | 175/107 |
| 6,557,642 | B1 * | 5/2003 | Head | 166/381 |
| 6,568,485 | B1 * | 5/2003 | Falgout, Sr. | 175/107 |
| 6,854,953 | B1 * | 2/2005 | Van Drentham-Susman et al. | 175/107 |
| 6,920,946 | B1 * | 7/2005 | Oglesby | 175/107 |

FOREIGN PATENT DOCUMENTS

| | | |
|---|---|---|
| EP | 0921268 | 2/1999 |
| GB | 2044826 | 10/1980 |
| GB | 2328464 | 2/1999 |

OTHER PUBLICATIONS

SPE 60756—"*Controlling Small Positive-Displacement Motors when used wit Coiled Tubing and Compressible Fluids*"—Lance Portman, John Ravensbergen and Paul Salim, BJ Services, Copyright 2000, Society of Petroleum Engineers Inc.

Roto-Jet® Rotary Jetting Tool—Product Sales Bulletin; BJ Services Company Apr. 11, 2002.

Copy of "Search Report Under Sections 17 and 18(3)", Dated Jun. 15, 2005 by the Patent Office of the United Kingdom for British Patent Application No. GB0500800.8 (3 Pages Total, Including Examiner's Cover Letter).

* cited by examiner

*Primary Examiner*—David Bagnell
*Assistant Examiner*—Matthew J. Smith
(74) *Attorney, Agent, or Firm*—Howrey LLP

(57) ABSTRACT

A flow control valve is disclosed for controlling the rotation of a hydraulic motor, such as a turbine, a mud motor, for example, having an element that rotates in response to power fluid. The valve disclosed may include a valve housing and a valve piston, each having a port, moveable relative to one another. When the ports at least partially align, bypass flow is generated which acts to decrease the speed of rotation of the element, such as a turbine shaft. An energizer, such as a pump assembly, is further described which is adapted to move the valve housing or the valve piston in response to the speed of rotation, such that bypass flow is a function of the motor speed (i.e. speed of rotation of the element). A bottom hole assembly including a flow control valve and a method of controlling the rotation of a downhole tool are also described.

31 Claims, 4 Drawing Sheets

FLOW CONTROL VALVE AND METHOD OF CONTROLLING ROTATION IN A DOWNHOLE TOOL

BACKGROUND OF THE INVENTION

1. Field of the Invention

The present invention relates to performing downhole operations in wellbores in the field of oil and gas recovery. More particularly, this invention relates to a device adapted to improve the control of the speed of a downhole hydraulic motor.

2. Description of the Related Art

In the oil and gas industry, various operations utilize the rotation of a downhole tool or apparatus. For instance, downhole tools such as drill bits, mills, and scale removal devices are rotated downhole to perform a given operation. A downhole hydraulic motor, such as positive displacement motors (PDMs) and turbines may be used to generate this rotational power.

Generally, a pump at surface injects a working fluid downhole through a drill string, work string, or coiled tubing string. The work fluid is delivered to the downhole hydraulic motor to provide rotational movement to the downhole tool or apparatus attached thereto, such as a drill bit, a scale removal device, etc. For instance, in the case of a turbine, the working fluid rotates the turbine shaft to create rotational movement; in the case of a mud motor, the working fluid rotates the rotor to create rotational movement.

It is known that an optimal, predetermined rate of rotation of a particular downhole tool may be desired (e.g. 400 rpm) to perform a given operation. For instance, it is known to use a scale removal device, such as the ROTO-JET commercially-available from BJ Services Company, to clean scale and debris from a well bore. Such a jetting device is a downhole tool comprised of a set of nozzles mounted to a turbine. Fluid is injected downhole, which spins the turbine shaft within the turbine at a given speed. The fluid passes through the turbine to the jetting device and out the rotating nozzles to remove scale and debris from the wellbore.

It has been discovered that at an optimal rotational speed, the jetting device (having opposing jets aimed in a substantially radial direction) may induce pressure pulsing or stress cycling in the scale that is to be removed from the wellbore. In some instances, the optimum rotation of the jetting device is 400 rpm. Further, by accurately controlling the flow rate of the turbine shaft in the turbine, the life of the turbine is improved.

It is therefore desirable to control the speed of the turbine under varying conditions to optimize de-scaling performance. Thus, it is desirable to have a cleaning jet that rotates at an optimal speed, e.g. 400 rpm, regardless of temperature, injection flow rates, flow rates through the tool, single or two-phase fluid flow, torque loading of the shaft, etc.

Similarly, it is also desirable to improve the control of the rate of rotation of other downhole tools. For instance, optimum life and drilling performance is a significant concern when utilizing a mud motor for drilling or milling, especially with two-phase fluids, as excessive rates of rotation or stalling may occur due to the compressibility of the power fluid. A description of the difficulties associated with the control of mud motors on two-phase fluids is described by Lance Portman, John Ravensbergen, and Paul Salim, in "Controlling Small Positive Displacement Motors when used with Coiled Tubing and Compressible Fluids," SPE Paper 60756, Copyright 2000, Society of Petroleum Engineers Inc., incorporated herein by reference. Thus, there is a need to improve the control of the rate of rotation of the drill bit by the mud motor, which improves drilling efficiency and increases the mud motor life.

However, in prior art systems, it is not generally possible to maintain the optimal rate of rotation at surface. Generally, the speed of the hydraulic motors is affected by changing the flowrates of the working fluid therethrough. To increase the rotational speed of the downhole hydraulic motor, working fluid flow is increased. However, the actual speed of the hydraulic motor downhole is not known with sufficient accuracy at surface to accurately control the rotation in this way. This is especially true in the case of two-phase (compressible) flow.

Further, many variables impact the output speed of the hydraulic motor: flow rate and pressure drop across hydraulic motor, wellbore temperature, and absolute wellbore pressure. Two-phase flow exacerbates this problem. Thus, it is difficult to sufficiently control the rotational speed of the hydraulic motor and thus of the downhole tool.

It is also known that in prior art systems, it is tedious, difficult, or even impossible to initially set up the tool such that it will operate at a predetermined rate at bottom hole conditions (pressure, temperature, etc.) and for a known or given flow rate. As such, the hydraulic motors may rotate excessively, causing damage to themselves or the tools they are rotating. Alternatively, the hydraulic motors and the downhole tools attached thereto may rotate at a less-than-optimal rate.

Additionally, there are competing demands on flow rate of the circulating or working fluid. For example, the flow rate of nitrogen is typically used to control bottom hole pressure. Cuttings transport is another independent demand on flow rate. In addition, other demands influence the rotational speed generated by the downhole hydraulic motor, such as circulating flow rate, the depth of treatment, well bore temperature, hydrostatic pressure, and frictional pressure drop changes. However well bore conditions are not always known with sufficient certainty, especially bottom hole pressure, to ensure the downhole hydraulic motor rotates at or near the optimal, predetermined level. Therefore it may be difficult to appropriately predict circulating flow rates under the conditions set up for the hydraulic motor and downhole tool, such as a scale removal unit or a drill bit.

Computer modeling may be used to attempt to account for these competing demands on working or circulating flow rate, such that the rate of rotation of the downhole tool is managed and a best compromise can be determined. Further, in some prior art systems, a hydraulic motor is designed in an attempt to rotate at an optimal, predetermined rate, based on various design parameters such as these predicted downhole conditions. However, this has been found to be problematic, since the values of such parameters are not initially known with certainty. Further, the value of these parameters are not constant. Thus, the downhole hydraulic motor rotates above or below the predetermined rate.

Therefore, it is desirable to have an apparatus which may better control the flow rate into the hydraulic motor, such as a turbine, mud motor, etc., such that the rotational speed generated by the hydraulic motor can be controlled across a wide range of flow rates, torque loads, temperatures, pressures, and other operating conditions. This optimizes the performance of the attached downhole tool (e.g. drill bit or de-scaling unit) for drilling or scale removal, for example, and increases in the life of the hydraulic motor and downhole tool attached thereto.

It is also desirable to improve feedback to the operator at surface, especially in the case of two-phase flow.

Thus, a need exists for a device for improving control of the speed of a downhole hydraulic motor. There is a need to regulate the flow rate of the working fluid to the hydraulic motor, such that the rotating element (e.g., rotor or turbine shaft) rotates at an optimal, predetermined rate. The device should take into account changes in the operating conditions—such as temperature, pressure, and flow rates, e.g.—of the downhole tool. It is also desirable for the device to provide improved communication to the operator at surface.

In an attempt to overcome or minimize these problems, one embodiment of the present invention provides two flow paths through the bottom hole assembly: one flow path through the hydraulic motor, which drives the hydraulic motor, and one bypass flow path which is not used to drive the hydraulic motor. The flow control valve of preferred embodiments therefore meters the flow between these two flow paths to control the speed of rotation downhole without surface intervention. The two flow paths may then recombine and enter the downhole tool (such as a de-scaling unit) if desired. Thus, the overall flow rate of working fluid to the downhole tool is not diminished, while the speed of the hydraulic motor is optimized. This is advantageous, for example, when the downhole tool is a de-scaling apparatus having jets, and it is desirous to have as much fluid as possible exiting the jets.

SUMMARY OF THE INVENTION

The invention relates to a device and method for improving the control of a rotating element of a hydraulic motor. A flow control valve for a hydraulic motor is described, the motor being a turbine or a mud motor, for example. The hydraulic motor that is being controlled has an element, such as a turbine shaft or a rotor, that rotates in response to the flow of a working fluid. The flow control valve has a valve housing and a valve piston. The valve is coupled to-the hydraulic motor. The valve housing has a valve housing port therethrough, and the valve piston has a valve piston port therethrough. The valve housing and valve piston are moveable relative to one another and are adapted to establish a bypass flow when the valve housing and valve piston ports are at least partially aligned. An energizer, such as a pump assembly, is coupled to the valve. The energizer is adapted to move either the valve housing or the valve piston in proportion to the motor speed (i.e. the speed of rotation of the rotating element such as the turbine shaft).

For instance, the energizer may be a pump assembly having a stationary shaft with the pump rotating around the shaft. The pump may pump a control fluid in a closed system to move the piston relative to the housing thus affecting bypass flow. The bypass flow is therefore proportional to the speed of the hydraulic motor.

For instance, the Flow Control Valve disclosed herein may meter the fluid flow to deliver a desired amount of flow at the appropriate pressure drop across a hydraulic motor so as to maintain an optimal rotational speed of the mole of a jetting tool, e.g. 400 rpm. The Flow Control Valve disclosed in some embodiments thus senses if the rotational speed of the hydraulic motor has varied. If the rotational speed drops below its optimal rotational speed, the Flow Control Valve delivers more power fluid flow to drive the hydraulic motor. Alternatively, if the rotational speed of the hydraulic motor becomes excessive, e.g. in excess of 400 rpm, the Flow Control Valve increases the bypass flow, thus delivering less power fluid to drive the hydraulic motor and the downhole tool attached thereto.

At least two significant advantages may arise with the disclosed Flow Control Valve. First, the Flow Control Valve may adjust the flow rate to meet the instantaneous power requirements of the hydraulic motor. This is especially significant for two phase flow. Second, better communication between the Bottom Hole Assembly and the operator at surface is realized.

A control valve is described for a hydraulic motor having an element that rotates at a speed in response to a power fluid. The control valve in some embodiments may include a valve housing and a valve piston, the valve coupled to the hydraulic motor. The valve housing may have a valve housing port therethrough and the valve piston may have a valve piston port, with the valve housing and valve piston moveable relative to one another and adapted to establish a bypass flow when the valve housing and valve piston ports are at least partially aligned. The control valve may include a pump assembly coupled to the valve and adapted to move either the valve housing or the valve piston in response to the rotation of the element such that the bypass flow of the working fluid through the housing and piston ports is dependent on the speed of rotation of the element. In some embodiments, the bypass flow is reduced when the rotating element is below a predetermined speed of rotation, and the bypass flow of the working fluid is increased when the speed of rotation of the element is above the predetermined speed of rotation.

The hydraulic motor may comprise a mud motor with a rotor, or a turbine with a turbine shaft, for example. Downhole tools are also described as drill bits and de-scaling units, by way of example only. A pump assembly is described for a flow control valve, the pump having a pump shaft and a pump rotatable relative to the pump shaft, the pump adapted to pump control fluid at a rate proportional to the speed of rotation of the rotating element through a control fluid system to cause relative movement between the valve piston and valve housing.

Also described is a bottom hole assembly for performing an operation downhole, comprising a hydraulic motor that has an element that rotates in response to a flow of a power fluid defining the speed of the hydraulic motor, a downhole tool, and a control valve for controlling the speed of the hydraulic motor by directing working fluid through the bottom hole assembly, the control valve coupled to the motor and having a valve housing having a housing port, a valve piston having a valve piston port, the valve piston and valve housing being moveably connectable to one another and adapted to establish a bypass flow when the valve housing and valve piston ports are at least partially aligned, and a pump assembly coupled to the valve and adapted the selectively increase the bypass flow when the motor speed is above a predetermined speed and to selectively decrease the bypass flow when the motor speed is below the predetermined speed.

A method of controlling the rotation of a downhole tool is also disclosed including attaching a downhole tool to a hydraulic motor and providing a flow control valve described herein.

BRIEF DESCRIPTION OF THE DRAWINGS

FIGS. 1B–H show the Bottom Hole Assembly of FIG. 1A separated into six individual figures.

DESCRIPTION OF ILLUSTRATIVE EMBODIMENTS

Illustrative embodiments of the invention are described below as they might be employed in the oil and gas recovery operation. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Figure 1A:
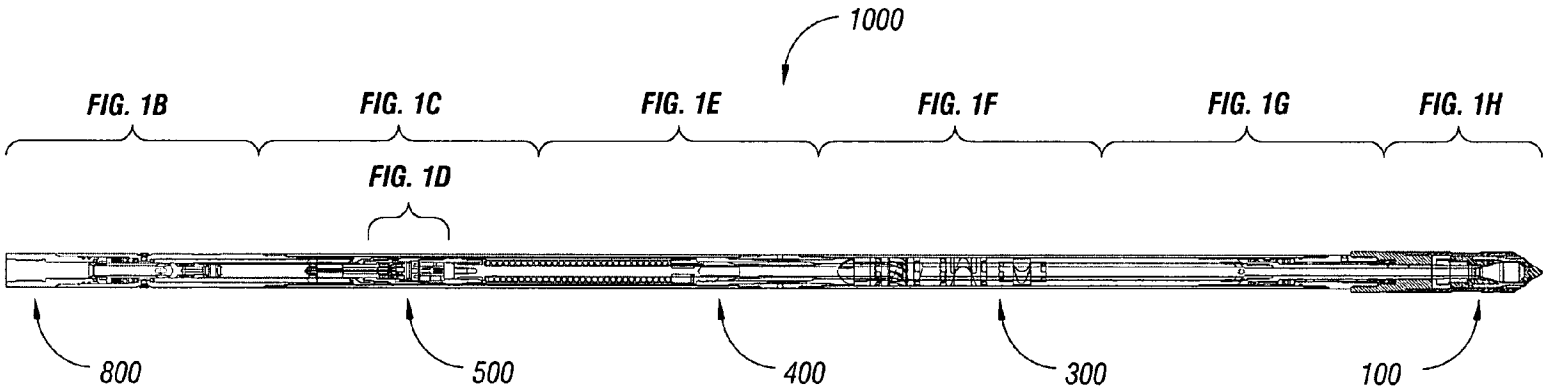
FIGS. 1A–H show an embodiment of the Bottom Hole Assembly of the present invention comprising a Flow Control Valve.

Embodiments of the invention will now be described with reference to the accompanying figures. A Bottom Hole Assembly 1000 ("BHA") of one embodiment of the present invention is shown in FIG. 1A, as comprising a downhole tool, such as a de-scaling unit 100, a hydraulic motor, such as a turbine 300, and a flow control valve 400 including an energizer, such as a pump assembly 500.

This Bottom Hole Assembly 1000 may be lowered into a wellbore via connection to an upper cross-over 800, for example, attached to a coiled tubing string, a work string or a drill string.

The downhole tool may comprise any rotational tool used downhole, such as a drill bit, a mill bit, or a de-scaling tool or unit 100, for example. In operation, the downhole tool may be rotated by the hydraulic motor to perform a given operation. Referring now to FIG. 1A, the downhole tool is shown at the bottom (i.e. farthest to the right) of BHA 1000. In this embodiment, the downhole tool is comprised of a de-scaling tool 100, such as the commercially-available ROTO-JET Rotary Jetting Tool for removing scale from the wellbore, described above.

Figure 1B:
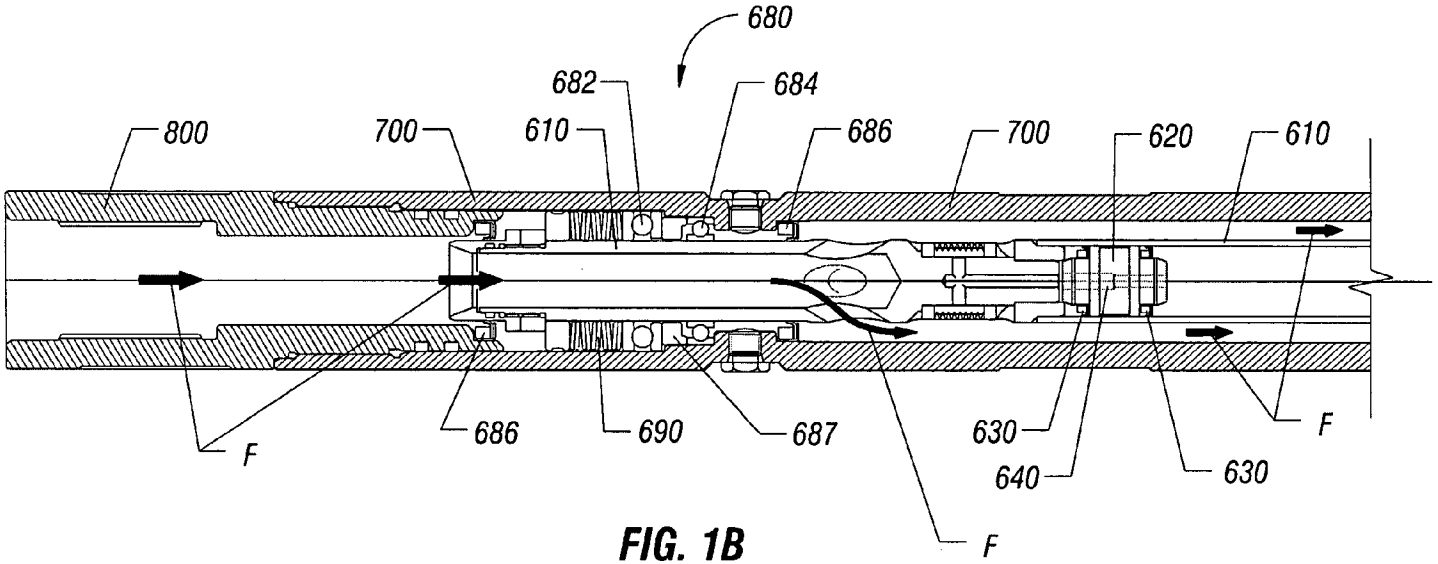
Figure 1D:
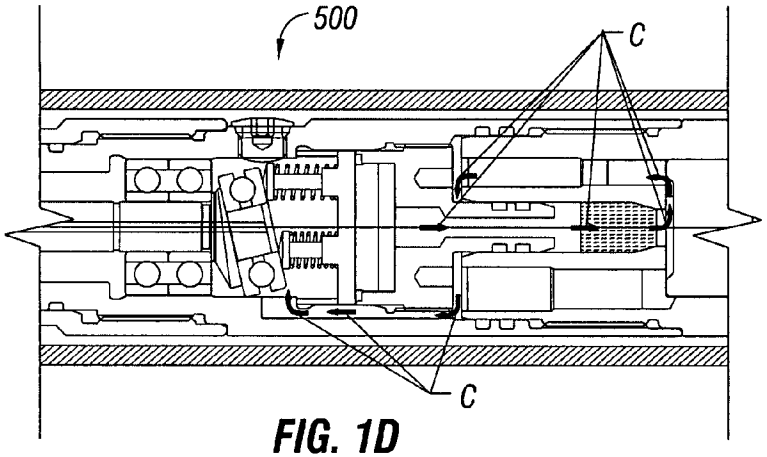
Figure 1C:
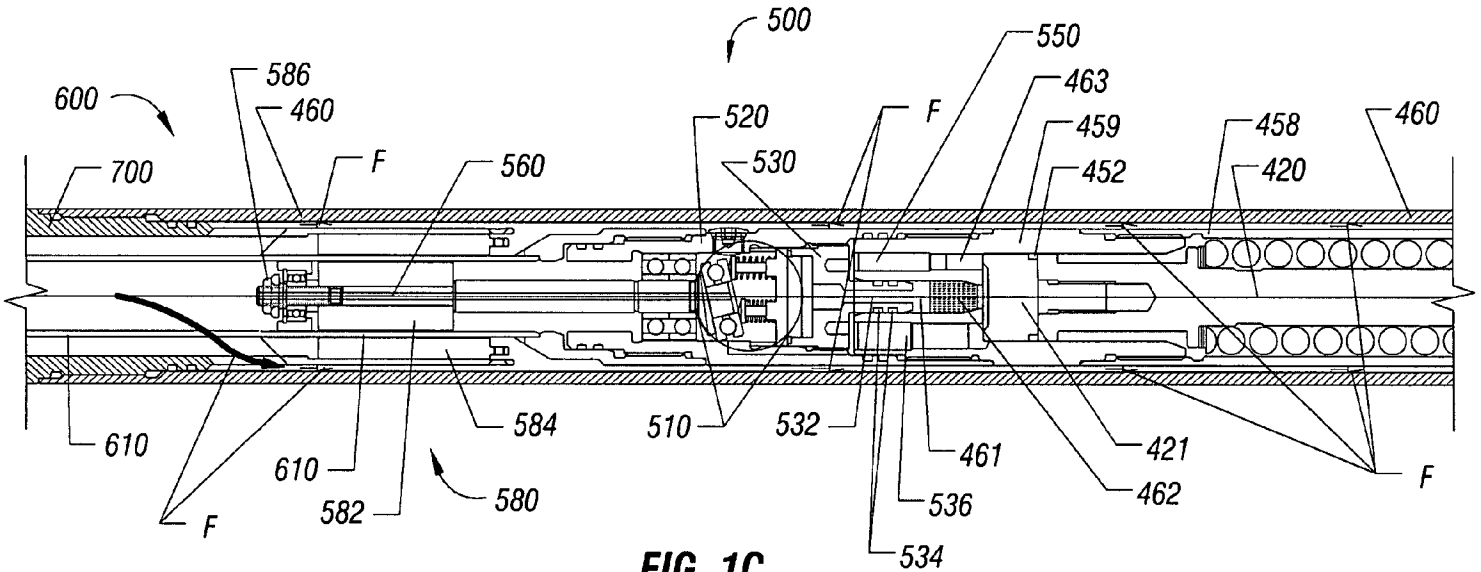
Figure 1E:
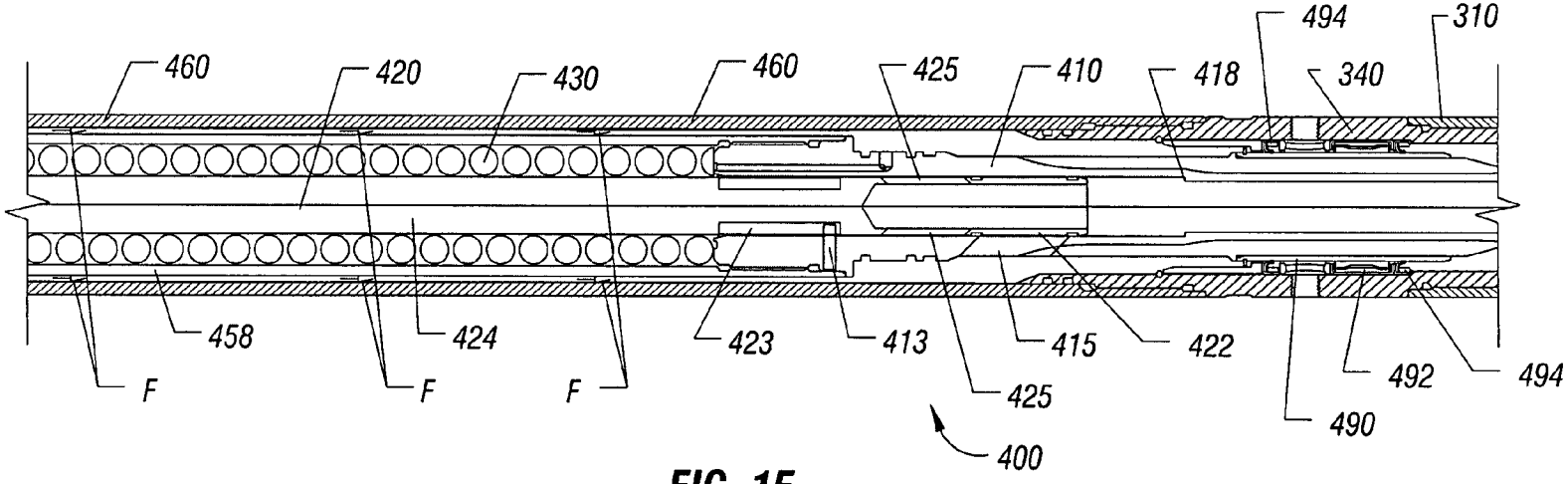
Figure 1F:
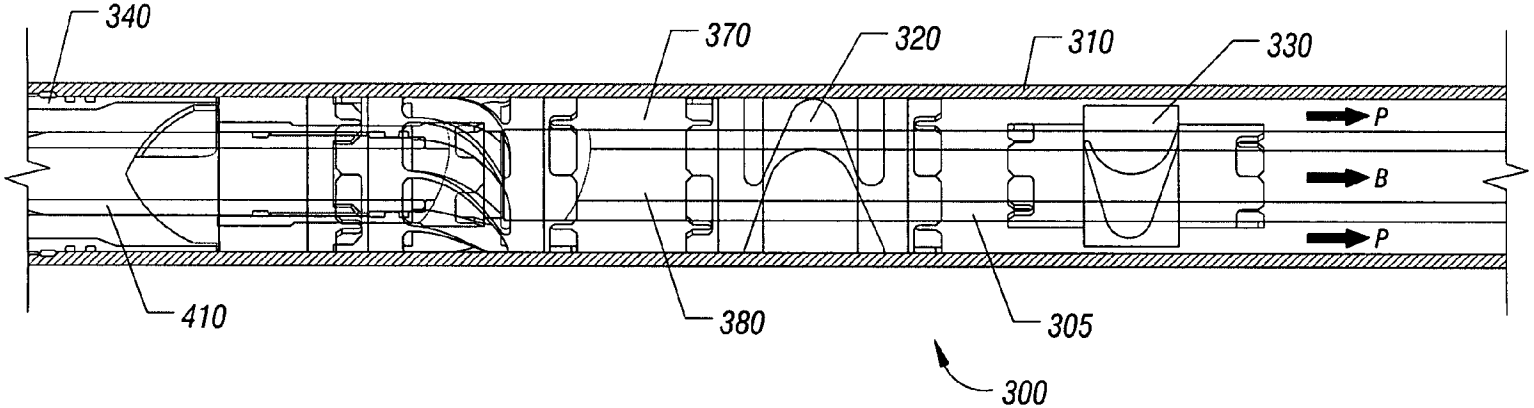
Figure 2:
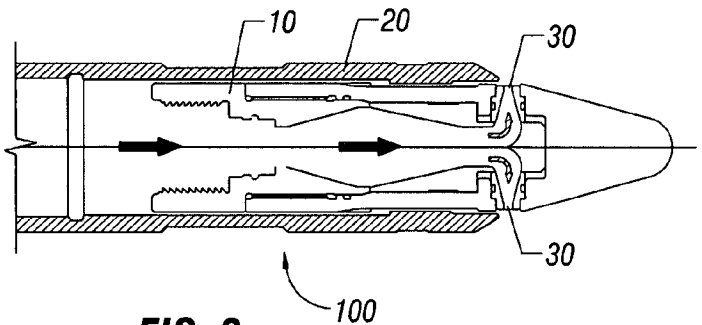
FIG. 2 shows a downhole tool of one embodiment of the present invention having a de-scaling unit.

It should be noted that the downhole tool may include a mole 10 within a shroud 20. In this embodiment, the downhole tool is a de-scaling unit 100 that includes nozles 30, which may be angled at 45 degrees from the axis of the downhole tool (as shown in FIGS. 1A and 1H), although any number of nozzles at any given configuration may be used. For example, as shown in FIG. 2, two nozzles 30 are shown at 90 degrees.

In this embodiment, the mole 10 is connected to the mole shaft 200 via mole mount split ring 202. The mole shaft 200 is hollow to provide fluid communication therethrough to the downhole tool, if desired.

The downhole tool may be connected to a hydraulic motor having a rotating element utilized to rotate the downhole tool. As such, the hydraulic motor may be a turbine 300, mud motor, or any type of downhole motor known to one of ordinary skill in the art having the benefit of this disclosure. In the embodiment shown in FIG. 1A and FIGS. 1E–H, the hydraulic motor is shown as a turbine 300 having a rotating element, shown as a turbine shaft 305. The rotating element may comprise a rotor of a mud motor, etc.

Figure 1G:
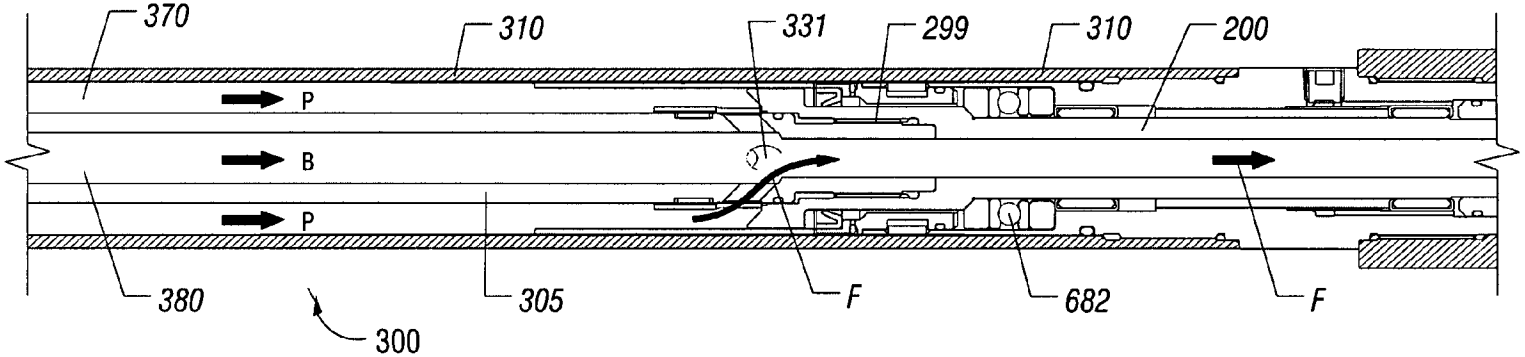
Figure 1H:
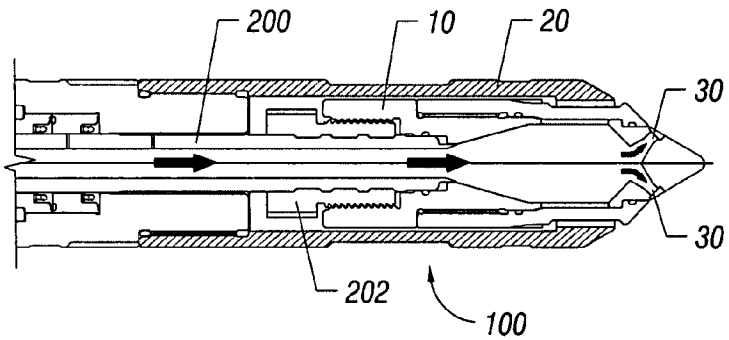

As shown in FIG. 1G, mole shaft 200 of the downhole tool is connected to the turbine 300 at the turbine shaft 305 via connection 299, such as a 0.750–12 SA threaded connection, for example. As will be discussed in more detail hereinafter, turbine shaft 305 may be hollow in this embodiment, and may include power fluid flow ports 331 providing fluid communication through the walls of the hollow turbine shaft 305. Similarly, if the downhole tool is a drill bit and the hydraulic motor is a mud motor, the shaft 200 would be connected to the rotor of the mud motor.

The turbine shaft 305 is located within turbine housing 310. Turbine stators 320 and rotors 330 are also located within turbine housing 310. Turbine housing 310 is connected to crossover 340.

An annular space is shown between turbine shaft 305 and turbine housing 310 defining a power fluid flow path 370, which allows power fluid to flow (in the directions shown by path "P") through the hydraulic motor ("power flow") to rotate the rotating element, such a the turbine shaft 305, within the hydraulic motor, such as turbine 300. In this embodiment, as power fluid passes through power fluid flow path 370 over the turbine stators 320 and rotors 330, the turbine shaft 305 rotates with respect to the turbine housing 310. Further in this embodiment, the turbine shaft 305 is hollow, defining a bypass flow path 380 therein, which may also provide fluid communication through the hydraulic motor, but so as not to rotate the rotating element of the hydraulic motor as described more fully hereinafter. In another embodiment, fluid flow over the rotor of a mud motor rotates the rotor, for example, while bypass flow does not rotate the rotor.

The turbine 300 in this embodiment is connected to the Flow Control Valve 400 of the present invention via a crossover 340, although any suitable type of connecting means may be utilized. Crossover 340 may further comprise a wipers 494 (e.g. Shamban Variseal part #567350-528), and may include radial needle bearing 492 (such as Torrington Part #B-1710) to reduce friction between rotating parts and to provide radial support therebetween.

In this embodiment, the Flow Control Valve 400 is generally comprised of valve housing 410 and valve piston 420. Valve piston 420 may have a hollow lower section 422, a solid on its middle section 424, and a piston top 421. The lower, hollow section 422 of the valve piston 420 may comprise at least one piston port 425. As shown, the uppermost section of the valve piston 420, referred to as the valve piston top 421, may comprise a groove 452 having a dynamic seal.

Further, valve housing 410 may comprise at least one housing port 415, shown in FIGS. 1A and 1D as a slot. As will be explained in detail hereinafter, when valve piston ports 425 at least partially align with valve housing port 415, fluid communication is possible therethrough thus opening the valve. As shown in FIGS. 1A and 1E, the Flow Control Valve 400 is in its closed position, preventing fluid communication through valve piston ports 425 and valve housing ports 415. Further, it will be appreciated by one of ordinary skill in the art that the shape of the ports 415 and 425 may comprise slots, ovals, or any other desired shape. Further, multiple ports 415 and 425 may be provided, although one of each is needed in preferred embodiments.

As shown in FIGS. 1A and 1E, alignment pins 413 in the valve housing 410 may engage grooves 423 in the valve piston 420 to limit the movement of the valve piston 420 within the valve housing 410.

Valve housing 410 is connected to the outer valve housing 460 by crossover 340. Shown between crossover 340 and valve housing 410 is a shaft centralizer 490, which may assist in mechanically centralizing main valve housing 410 and may reduce friction between rotating parts. Shaft centralizer 490 may be comprised of aluminum bronze bushing having a plurality of holes to provide fluid flow therethrough. Alternatively shaft centralizer may comprise a bearing assembly comprised of a radial needle bearing 492 (such as Torrington Part No. B-1710) and may include a pair of shamban wipers 494 (such as Variseal part no. 567350-5281).

Referring to FIGS. 1A, 1C, and 1E, the middle solid section 424 of valve piston 420 is shown circumscribed by a biasing means, such as valve spring 430. The valve spring 430 is also circumscribed by spring housing 458. An annular space exists between the spring housing 458 and outer valve housing 460 to allow the working fluid to flow downhole in the direction of the flow path "F."

Valve spring 430, or any other biasing means known to one of ordinary skill in the art, biases valve piston 420 in its upper-most position, i.e. the position farthest to the left as shown in FIGS. 1A and 1C. In this position, the Flow Control Valve 400 is closed and fluid communication through the valve housing ports 415 and the valve piston ports 425 is prevented.

The valve spring housing 458 is shown attached to a pump crossover 459, which circumscribes piston top 421 et al. The pump crossover 459 is located at the upper end of spring housing 458 and abuts an upper surface of the piston top 421 when the Flow Control Valve 400 is in the closed position.

The Flow Control Valve 400 may also comprise an energizer adapted to provide relative movement between the valve piston 420 and the valve housing 410.

As shown in FIG. 1A, the preferred energizer comprises a pump assembly 500, although any other device adapted to provide relative movement between the valve housing 410 and the valve piston 420 in response to the speed of rotation of the hydraulic motor may be utilized, such as magnets or viscous drag.

The valve piston 420 is adapted to be moved axially with respect to the outer valve housing 460 and valve housing 410 by the pump assembly 500 in this embodiment.

As shown in FIGS. 1A, 1C, and 1D, pump assembly 500 may be comprised of a pump 510 rotationally mounted within pump housing 520. The pump 510 may be any commercially-available pump, which satisfies the desired performance characterstics, such as a Hydro RENE LeDuc Model PB32.5 micro-hydraulic pump. Pump housing 520 is attached to the pump crossover 459.

As shown in FIGS. 1A, 1C, and 1D, located within pump housing 520 is the pump 510, a pump bulkhead 530, and a portion of the pump crossover 459. The pump bulkhead 530 may have a channel 532 therethrough, and grooves 534 on its periphery as shown. The pump outlet filter 462 may be installed in the channel 532 or in any location downstream of pump bulkhead 530. The pump bulkhead 530 may be functionally associated within the pump crossover 459, as shown in FIGS. 1A, 1C, and 1D.

Control fluid C, such as hydraulic fluid, may travel throughout the energizer, such pump assembly 500, in a closed loop, as shown in FIG. 1D by the flow arrows "C". Control fluid is enclosed within the pump bulkhead 530 in a closed system as described hereinafter.

Also described in FIG. 1C is magnetic coupling 580, comprised of a male 582 and a female portion 584. The male portion 582 of the magnetic coupling 580 is attached to the pump shaft 560 via modified nylock nut 586. The female portion 584 of the magnetic coupling 580 is attached to the upper bearing housing, described hereinafter. The male portion 582 of magnetic coupling 580 is shown within the female portion 584 of magnetic coupling 580. The magnetic coupling 580 is provided in this embodiment to apply rotational motion to the pump shaft 560 while keeping the control fluid separate from the working fluid pumped down the coil. As shown, in this embodiment, the accumulator shaft 610 may be relatively thin and may passes between the female portion 584 and male portion 582 of the magnetic coupling 580. In operation, the accumulator shaft 610 rotates with the rotating element, such as turbine shaft 305. Thus, the magnetic coupling 580 magnetically maintains the angular position of the pump shaft 560 while the accumulator shaft rotates; i.e. the magnetic coupling 580 does not physically touch the accumulator shaft 610, in this embodiment.

The energizer, such as pump assembly 500 in this embodiment, may also include an accumulator 600 to accumulate sufficient control fluid such as hydraulic fluid and to account for changes in operating pressure experienced downhole. The accumulator 600 is located on the suction side of the pump 510 in this embodiment and above the magnetic coupling 580. Within accumulator shaft 610 is an accumulator piston 620 adapted to travel axially within the accumulator shaft 610 to define the accumulator 600. The upper surface of the accumulator piston 620 contacts the working or circulating fluid, while the lower surface of the accumulator piston 620 contacts the control fluid, such as hydraulic fluid, on the suction side of the pump 510. Shown within the accumulator piston 620 are seals 630, e.g. Variseal part no. S67150-3051.

The accumulator piston 620 is movable axially within the accumulator shaft 610. As such, the axial location of the accumulator piston 620 within accumulator shaft 610 is dependent on the volume of hydraulic control fluid apportioned to the actuator piston and cylinder 421. Partially because the accumulator 600 delivers control fluid to the suction side of the pump 510, the Flow Control Valve 400 thus takes into account the operating pressure of the working or circulating fluid in operation.

Should the control or hydraulic system leak, or should the volume of the fluid within the system increase due to high temperatures, the excess volume of control or hydraulic fluid may pass from the suction side of the pump 510, through the pump shaft 560 between the magnetic coupling 580, and be accommodated in the accumulator 600 until the system cools. As the system cools, e.g. when the tool is coming out of the hole, the control fluid contracts, and the accumulator piston 620 will then displace the control fluid, such as hydraulic fluid, back into the control fluid system, thus ensuring the pump 510 does not cavitate.

The accumulator piston 620 may also include a pressure relief valve 640, such as one commercially available from LEE, part no. PRRA1872060L, 60 p.s.i. , the operation of this is described hereinafter.

Located on the end of the accumulator shaft 610 is a bearing assembly 600. Within bearing assembly 680 is a thrust bearing 682 and a radial bearing 684, separated by a bearing spacer 687. Shamban wipers 686 are shown on either side of the bearings to contain the associated grease. Above bearing assembly 680 is Belleville washer spring set 690, which operates to share the thrust load across two thrust bearings: one described above as thrust bearing 682, and one located downhole as thrust bearing 682' (FIG. 1).

Circumscribing the accumulator shaft 610 is upper valve housing 700, which is attached to outer valve housing 460. Upper valve housing 700 is attached to upper cross over 800, which may be attached to the coiled tubing, work string, or drill string.

Operation

The operation of the Flow Control Valve 400 of Bottom Hole Assembly 1000 is described hereinafter. Generally, Flow Control Valve 400 operates to divert the flow of working fluid from the power fluid path to a fluid bypass. As the working fluid passes through the bottom hole assembly 1000, a portion of the working fluid may be diverted based on the speed the hydraulic motor (i.e. the speed of rotation of the rotating element of the hydraulic motor, such as the speed of rotation of the turbine shaft 305 of the turbine 300).

Initially, when the Bottom Hole Assembly 1000 is being run downhole, the Flow Control Valve 400 may be in the completely closed position such that fluid communication between the valve housing ports 410 and the valve piston ports 425 is prevented. (Alternatively, the Flow Control Valve 400 initially may be set up to be partially open to divert some of the working fluid, E.G. 20%, to bypass flow, as will be described hereinafter.) As fluid passing through at least one valve housing port 415 and at least one valve piston port 425 defines the fluid bypass flow, no bypass fluid flow exists when the Flow Control Valve 400 is completely closed.

With the Flow Control Valve 400 completely closed, the Bottom Hole Assembly 1000 operates similar to prior art systems having no flow control valve. A prime mover at surface provides a circulating or working fluid pumped down the coiled tubing string, work string, or drill string. That is, the circulating or working fluid follows flow path denoted by "F" (as shown in FIGS. 1B, 1C, and 1E). Because the Flow Control Valve 400 is in the closed position, the ports 425 in the valve piston 420 are not aligned with the ports 415 in the main valve housing 410. Thus, no circulating or working fluid is diverted to the fluid bypass B via the Flow Control Valve 400. As such, with the Flow Control Valve 400 closed, all of the working fluid passes into the power fluid flow path 370 (FIGS. 1F and 1G).

As shown in FIGS. 1F–1G and with the Flow Control Valve 400 closed, all of the working fluid thus follows the flow of power fluid "P" in power flow path 370 acting to rotate the rotating element of the hydraulic motor. For instance, the power fluid may pass across the turbine stators 320 and turbine rotors 330 of the turbine 300 to rotate the turbine shaft 305. Alternatively, the power fluid could rotate a rotor of a mud motor, e.g., or drive any other rotatable element of a hydraulic motor. Upon exiting the hydraulic motor, the working fluid enters the downhole tool, such as in this case, the ROTO-JET tool and out its nozzles, to perform a jetting operation, such as scale removal from the wellbore. Of course, the downhole tool could comprise a drill bit or any other rotatable downhole tool.

When initially being run into the hole, the accumulator 600 within the accumulator shaft 610 is full with control fluid, in this embodiment. Thus, the accumulator piston 620 would appear to the far left in FIGS. 1A and 1B within the accumulator shaft 610 in FIGS. 1A and 1B. Thus, initially, a maximum amount of control fluid is downhole of accumulator piston 620.

Once the rotating element of the hydraulic motor begins to rotate in response to the flow of the working fluid, the energizer is activated as described hereinafter.

Once working fluid is injected into the bottom hole assembly 1000, the rotating element of the hydraulic motor begins to rotate. The rotation of the element acts to power the energizer such as pump assembly 500 to control the relative position of the valve housing 410 and valve piston 420 in response to the speed of rotation. Thus, the Flow Control Valve delivers working fluid to rotate the element as power fluid "P" in power fluid flow path 370, or diverts working fluid to bypass flow "B" through bypass flow path 380 depending on the speed of rotation of the rotating element.

As the rotating element of the hydraulic motor begins to rotate, various components of the Flow Control Valve 400 also begin to rotate because of the construction of the Bottom Hole Assembly 1000 described above. For instance, in this embodiment, as the turbine shaft 305 begins to rotate, valve housing 410, the valve piston 420, the valve spring 430, valve spring housing 458, the pump 510, the pump cross over 459, the accumulator 600 including the accumulator shaft 610 and accumulator piston 640, each rotate with the turbine shaft 305 in this embodiment. In short, all components attached to the turbine shaft 305 rotate at the same speed as the turbine shaft 305.

However, other components of the Bottom Hole Assembly 1000 and the Flow Control Valve 400 of this embodiment remain stationary and do not rotate, such as turbine housing 310, the pump shaft 560 (via its connection to the magnetic coupling 580), the outer valve housing 460, the upper valve housing 700, and the upper crossover 800.

Because the pump shaft 560 is stationary, and the remainder of the pump assembly 500 including the pump 510, the pump housing 520, pump bulkhead 530, etc., rotate at the same speed of rotation as the turbine shaft 305, the pump 510 rotates relative to the pump shaft 560 to activate the pump assembly 500. The pump 510 begins to pump the control fluid, as described hereinafter.

The flow of the control fluid through the energizer will hereinafter be described with respect to hydraulic fluid passing through the pump assembly 500. However, any control fluid may be utilized, along with any energizer adapted to perform the functions described herein.

As the pump 510 begins to rotate, the pump 510 acts to pressurize the hydraulic fluid. In this embodiment, the hydraulic fluid from the accumulator 600 (and thus at the same pressure as the circulating fluid if no pressure relief valve 640 is utilized), passes out of the pump 510, through the pump bulkhead 530, via channel 532 in the center of the pump bulkhead 530, and into inner longitudinal passage 461 in the upper section of the pump crossover 459, as shown by the arrows indicating control fluid flow "C" in FIG. 1D. The hydraulic fluid may pass though a filter 462, if used, within the inner longitudinal passage 461 in the upper section of the pump crossover 459.

Hydraulic fluid passing through the filter 462 then acts on valve piston 420 via the face of the piston top 421 of valve piston 420. As pressure builds within the closed hydraulic system, a pressure differential develops across seal 452 (located in a groove in the piston top 421) to develop a downward force on the upper surface of piston top 421. This downward force is dependent upon the pressure differential.

The spring 430 or other biasing means known to those of ordinary skill in the art having the benefit of this disclosure, operates to bias the piston top 421 against the pump crossover 459 to restrict the flow of hydraulic fluid through the closed hydraulic system. It should be noted that spring 430 may be pre-compressed or pre-loaded, as desired.

Once piston top 421 moves downwardly, hydraulic fluid may then pass from the filter 462 to the flow restrictor 550 inside the outer longitudinal passages 463 of the pump crossover 459. Flow restrictor 550 may comprise a LEE JEVA #1830468H, for example. Flow restrictor 550 may be sized such that it determines the pressure allowed within the pump crossover 459 before the hydraulic fluid is allowed to circulate. It should be noted that in some embodiments, some flow of hydraulic fluid flows even when piston top 421 is in its uppermost position, via a groove in the top of piston top 421 as shown in FIG. 1D. In these embodiments, once piston top 421 moves downwardly, the flow of hydraulic fluid is increase through the filter 462 to the flow restrictor 550.

The pressure drop across the flow restrictor 550 is thus dependent on the hydraulic flow rate. As the flow rate of the hydraulic fluid increases (i.e. with increased spinning of the pump 510 about pump shaft 560 as the speed of the hydraulic motor increases), a larger pressure drop forms across flow restrictor 550. Alternatively, if the pump 510 is spinning relatively slowly, then the flow rate of the hydraulic fluid is also decreased, and the pressure drop across the flow restrictor 550 is reduced. Thus, the flow rate of the hydraulic fluid of the pump is converted to a pressure drop across the flow restrictor 550, which generates the downward force on the face of the piston top 421.

As the pump 510 rotates, the hydraulic fluid becomes pressurized and creates a downward force acting on the piston top 421. When the downward force generated by the hydraulic fluid is sufficient to overcome the force of the valve spring 430, the valve piston 420 will move downwardly with respect to the outer valve housing 460 and with respect to the main valve housing 410 to open the Flow Control Valve 400.

The downward force will force the valve piston 420 downward a given distance until equilibrium is reached, i.e., until the downward force acting on the face of the piston top 421 equals the upward force of the valve spring 430. Once the valve piston 420 moves downward, the valve piston ports 425 in the valve piston 420 provide fluid communication through the valve housing ports 415 in the valve housing 410 to create bypass flow B therethrough.

Hydraulic fluid flows from the channel within the pump crossover 459 through the flow restrictor 550 back into the pump housing 520. The pump housing 520 is connected to a reservoir for the hydraulic fluid for the pump 510, which is also in fluid communication with the accumulator 600 described above.

It should be noted that a pressure relief valve 536 may be mounted on the pump crossover 459 to provide a safeguard against excessive pressure should the flow restrictor 550 become plugged or clogged. The pressure relief valve 536 may comprise a commercially-available component, such as one offered by Lee, part number PRFA1875080L. In this embodiment, the pressure relief valve 536 may control the maximum pressure of the hydraulic system. Thus, if pressure builds in the pump crossover 459 due to temperature effects (e.g. increasing temperature from running in the hole), and the flow restrictor 550 is plugged or clogged, the volume of hydraulic fluid is then trapped within the pump crossover 459, pressure will build up and damage the pump assembly 500. The pressure relief valve 536 thus may prevent the pump assembly 500 from failing due to over pressure.

As stated above, within accumulator shaft 610 is an accumulator piston 620 adapted to travel axially within the accumulator shaft 610. The accumulator piston 620 being moveable within the accumulator shaft 610 equalizes the pressure between the circulating fluid pressure (pressure of the working fluid) above the piston 620 and the pressure of the control or hydraulic fluid below the piston 620). As the tool is run in hole, the temperature of the hydraulic fluid increases to expand the hydraulic fluid. At some point, the accumulator piston 620 can no longer move upward within the accumulator shaft 610. Thus, the pressure of the hydraulic fluid begins to increase within the accumulator 600. Therefore, to protect the system, in some embodiments an accumulator piston relief valve 640 is provided within the accumulator piston 620.

In some embodiments, the accumulator piston relief valve 640 may be a 60 p.s.i. relief valve. When the pressure of the hydraulic fluid increases, the accumulator piston relief valve 640 opens and the excess hydraulic fluid is allowed to drain into the circulating fluids above the accumulator piston 620.

The extent to which the Flow Control Valve 400 is opened is dependent on the downward force generated by the pump 510, which is dependent on the pump rate of the pump 510, which is directly proportionate to the rate of rotation of the pump 510 and thus the speed of the hydraulic motor (being the rate of rotation of the rotating element of the hydraulic motor, such as turbine shaft 305 of turbine 300).

If the Flow Control Valve is at least partially open, bypass flow is established. Thus, a percentage of the working fluid is diverted to bypass fluid flow B through bypass flow path 380, the remainder of the circulating fluid passing through power fluid flow path 370. The Flow Control Valve may be initially set up such that some bypass flow (e.g. 20% bypass, 80% power fluid) is allowed when the predetermined speed of rotation is achieved.

If the speed of hydraulic motor is above a predetermined speed, then an increased portion of the working fluid is diverted from power flow to bypass flow. As less working fluid is delivered to drive the element (e.g. turbine shaft 305) of the hydraulic motor, the speed of rotation of the element (e.g. turbine shaft 305) is thus reduced, absent significant changes in other variables. Thus, in the embodiment illustrated, less working fluid is delivered through rotors 330 and stators 320 of the hydraulic motor.

Further, if the speed of hydraulic motor drops below the predetermined speed, the energizer, such as pump assembly 500, moves the valve piston 420 relative to the valve housing 410 such that bypass flow is reduced or even prevented. Thus, more or all of the working fluid flow is delivered as power fluid to drive the element (e.g. turbine shaft 305) of the hydraulic motor, thus increasing the speed of the hydraulic motor. In the illustrated embodiment, more power fluid is delivered through the rotor and stator arrangement.

The power flow P from the power fluid flow path 370 and the bypass flow from the bypass flow path 380 may be reunited via the flow ports 330. The total combined flow goes into the shaft 200. In this way, all of the working fluid is delivered downhole to the downhole tool. This may be advantageous in given situations, such as with the use of the ROTO-JET, such that 100% of the working fluid may be jetted through the nozzles 30 to perform a scale-removal operation, for example.

It will be appreciated by one of ordinary skill in the art having the benefit of this disclosure that in this way, the disclosed Flow Control Valve 400 operates to regulate the speed of the hydraulic motor, i.e. the rate of rotation of the rotating element of the hydraulic motor.

The output flowrate of pump 510 is directly proportional to the speed of the hydraulic motor. Thus, the faster the pump 510 rotates, the greater the flow rate of the hydraulic fluid exiting the pump 510, the greater the pressure differential across flow restrictor 550, the greater the pressure acting against the upper surface of piston top 421 to create a downward force. Once this downward force exceeds the force of the spring 430, the Flow Control Valve opens or opens further, bypassing the flow rate to the turbine 300 to slow the turbine down.

The faster the rotation of the turbine shaft 305, the greater the downward force on the valve piston 420, resulting in more bypass fluid being diverted from the power fluid. Thus, the bypass flow is proportional to the degree of alignment between the valve housing port 415 and the valve piston port 425, with the total flow rate of the working fluid remaining constant. The bypass flow is thus proportional to the speed of hydraulic motor. This is true up to a maximum (i.e. when the valve housing port 415 and valve piston 425 are in complete alignment). In such a maximum case, maximum circulating fluid is diverted into the bypass and minimum power fluid is delivered to the rotating device of the hydraulic motor. In this situation in this embodiment, the speed of hydraulic motor is therefore reduced. In this open position, the valve piston 420 contacts the shoulder 418 on the valve housing 410 to prevent further axial movement between the valve piston 420 and the valve housing 410.

It should be appreciated that the components of the Flow Control Valve 400 may be selected such that the Flow Control Valve 400 will operate as described herein. For instance, a spring 430 with a given spring constant may be selected such that when the pump rotates at 400 rpm and pressurizes the hydraulic fluid to create the downward force on the piston top 421, the spring 430 opposes the downward force to the desired degree (i.e. allowing some percentage of bypass flow). However, once the rate of rotation exceeds 400 rpm, the increased downward force overcomes the upward force of the spring 430 to further open the Flow Control Valve 400. Conversely, when the rate of rotation drops below 400 rpm, the decreased downward force is overcome by the upward force of the spring 430 to act to close the Flow Control Valve 400. Other variables may be altered to achieve the same design result, such as the surface area of the piston top 421, the size of the restrictor in the flow restrictor 550, the viscosity and density of hydraulic fluid, the flow rate per revolution of the pump, etc. Further, the Flow Control Valve 400 may be designed to function as stated above for any desired predetermined hydraulic motor speed. For instance, the predetermined desired rate may be 400 rpm for a de-scaling unit or another value for a drill bit on a mud motor, e.g.

Further, although in the figures the piston shaft is shown to move axially within the piston housing in this embodiment, the disclosure is not so limited. For instance, the piston housing could move and the valve piston could remain relatively stationary, or both could move. Further, the valve piston and valve housing could be rotatably connected, with radial movement changing the alignment of the ports. In the disclosed Flow Control Valve 400, relative motion between the valve piston and the valve housing to align the selectively align the ports is needed. The valve could open to annular ports instead of internal to the shaft.

It should be mentioned that the bypass flow through the bypass flow path 380 need not pass downwardly through the hydraulic motor, as shown in the embodiment of FIG. 1A. The bypass flow may, for instance, may flow out of the hydraulic motor in other directions. Further, although not shown, the Flow Control Valve 400 may be utilized in conjunction with a downhole phase separator, as would be realized by one of ordinary skill in the art having the benefit of this disclosure. In such a system, the downhole separator may supply the hydraulic motor with liquid only and the remaining two-phase flow may be discharged via gas discharge ports. The Flow Control Valve 400 may manage the flow rate to the hydraulic motor based on the motor speed by means of controlling the flow rate out of the separator's gas discharge ports instead of the usual bypass port.

EXAMPLES

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Examples follow. For the ROTO-JET example, and when operating at the predetermined motor speed of rotation of 400 rpm, the system may be designed for the Flow Control Valve 400 to divert 20% of the working fluid to bypass flow in the bypass flow path 380 of the turbine shaft 305, with 80% of the fluid remaining in the power fluid flow path 370 to power the turbine shaft 305. When the speed of the hydraulic motor (i.e. the rotational speed of the turbine shaft 305) exceeds the predetermined rate of 400 rpm, the Flow Control Valve 400 increases the bypass flow; when the motor speed (speed of rotation of the turbine shaft 305) drops below the predetermined speed of 400 rpm, the Flow Control Valve 400 decreases the bypass flow. In such embodiments, the spring constant of spring 430 may vary from between 300 to 500 pounds per inch, the area of the piston top 421 may vary between 0.4 and 0.7 square inches.

If the motor speed increases from 400 rpm to 450 rpm, the increase in rotational speed of turbine shaft 305 increases the pump rate, which increases the pressure of the hydraulic fluid, which increases the downward force on the piston top 421, which overcomes the upward force of the valve spring 430. The valve piston port 425 and the valve housing port 415 are placed in greater alignment (i.e., the flow area therebetween increases) to provide fluid communication therethrough to increase the bypass flow. Thus, additional working fluid is diverted to the bypass flow path 380, the remainder of the flow of the working fluid passing through the power fluid flow path 370 to rotate turbine shaft 305.

If the motor speed decreases from 400 rpm to 350 rpm (due to an increase in torque load, for example), the decrease in rotational speed decreases the pump rate, which decreases the pressure of the hydraulic fluid, which decreases the downward force on the piston top 421 such that the upward force of the valve spring 430 forces the valve piston 420 upward. The upward movement of the valve piston 420 moves the valve piston port 425 to reduce the alignment (i.e., the flow area therebetween decreases) with the valve housing port 415 to reduce the fluid communication therethrough. Thus, more of the working fluid is delivered as power fluid to drive or rotate the turbine shaft 305.

In this way, the Flow Control Valve 400 can control the flow rate of the power fluid into the turbine 300, and the speed of rotation of the turbine shaft 305 (hydraulic motor speed); thus the speed of rotation of the downhole tool such as a ROTO-JET can be controlled across a wide range of flow rates, torque loads, and changing coiled tubing flow rates for two-phase flow. In the case of the ROTO-JET, performance for scale removal is improved and an increase in the life of the Bottom Hole Assembly can be realized, especially with respect to the seals and bearings.

The Flow Control Valve 400 facilitates communicating of changes in input flow rate to the turbine to surface. For example, if the ROTO-JET downhole tool stalls, the turbine shaft 305 stalls and the bypass port would be completely closed by the Flow Control Valve 400 delivering all of the working fluid flow rate to drive the turbine shaft and drive the hydraulic motor. If under normal operating conditions the Flow Control Valve were set up with ⅔ the flow passing through the power fluid flow path of the turbine and ⅓ through the bypass, then the flow rate through the turbine under the new load conditions would be 50% greater and the overall pressure drop across the Bottom Hole Assembly would be roughly double. This sudden and large increase in pressure drop across the ROTO-JET downhole tool would be seen at surface, even when pumping compressible fluids. This increase in injection pressure would alert the operator at surface of the new load conditions on the ROTO-JET downhole tool and corrective actions could be taken, such as pulling out of the hole (POOH).

Without the Flow Control Valve 400, an increase in pressure drop may occur across the ROTO-JET downhole tool, as torque is related to pressure drop; however the pressure drop without the Flow Control Valve 400 will be smaller (20% instead of 200%) and can be more easily masked by compressibility of the pumped fluids.

Mud motors performance may also improve with the use of the Flow Control Valve described herein. The power requirements for a mud motor may be managed by the Flow Control Valve, which changes the "net realized" torque curves of the motor, depending on the response time of the Flow Control Valve. Therefore even on single phase fluids, an increase in ROP may be realized as the motor may operate at maximum efficiency across a wide range of loading conditions.

While the apparatus and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

What is claimed is:

1. A flow control valve for a hydraulic motor comprising:

a hydraulic motor having an element that rotates at a speed in response to a power fluid;

a valve having a valve housing and a valve piston, the valve coupled to the hydraulic motor, the valve housing having a valve housing port therethrough, the valve piston having a valve piston port, the valve housing and valve piston moveable relative to one another and adapted to establish a bypass flow when the valve housing and valve piston ports are at least partially aligned; and a pump assembly coupled to the valve and adapted to move either the valve housing or the valve piston in response to the rotation of the element such that the bypass flow of the working fluid through the housing and piston ports is dependent on the speed of rotation of the element.

2. The flow control valve of claim 1 in which the bypass flow is reduced when the rotating element is below a predetermined speed of rotation, and the bypass flow of the working fluid is increased when the speed of rotation of the element is above the predetermined speed of rotation.

3. The flow control valve of claim 2 wherein the bypass flow is proportional to the speed of rotation of the element up to a maximum bypass flow.

4. The flow control valve of claim 3 wherein the bypass flow is proportional to a degree of alignment between the housing and piston ports.

5. The flow control valve of claim 4 in which the hydraulic motor is a mud motor and the element is a rotor.

6. The flow control valve of claim 4 in which the hydraulic motor is a turbine and the element is a turbine shaft.

7. The flow control valve of claim 6 in which the pump assembly further comprises:

a pump shaft; and a pump rotatable relative to the pump shaft, the pump adapted to pump control fluid at a rate proportional to the speed of rotation of the turbine shaft through a control fluid system to cause relative movement between the valve piston and valve housing.

8. The flow control valve of claim 7 further comprising a magnetic coupling having a male and female portion, the male portion being attached to the pump shaft, the female portion circumscribing the male portion and attached to an upper bearing housing within an outer valve housing, the male and female portions of the magnetic coupling adapted to provide relative rotational motion therebetween.

9. The flow control valve of claim 7 wherein the control fluid comprises hydraulic fluid and the control fluid system is a hydraulic fluid system.

10. The flow control valve of claim 9 in which the hydraulic fluid system further comprises:

a pump bulkhead having a channel therethrough;

a pump crossover having an inner passage and an outer passage;

a flow restrictor inside the outer passage of the pump crossover; and a pump housing, wherein the pump pumps hydraulic fluid through the channel in the pump bulkhead, through the inner passage of the pump crossover, through the flow resistor, and through the pump housing to a suction side of the pump, the flow of hydraulic fluid through the hydraulic fluid system exerting a downward force on the piston proportionate to the rate of rotation of the turbine shaft.

11. The flow control valve of claim 10 further comprising biasing means functionally associated with the valve piston adapted to resist the downward force of the hydraulic system.

12. The flow control valve of claim 11 wherein the biasing means comprises a spring.

13. The flow control valve of claim 12 in which the pump assembly further comprises an accumulator defined by an accumulator piston within an accumulator shaft to contain a reservoir of hydraulic fluid, the accumulator piston contacting working fluid on an outside surface of the accumulator piston and the hydraulic fluid on an inside surface of the accumulator piston.

14. The flow control valve of claim 13 in which the accumulator piston further comprises a pressure relief valve to selectively provide fluid communication of control fluid out of the accumulator to protect the accumulator from overheating.

15. The flow control valve of claim 1 wherein the relative movement of the valve housing and the valve piston is axial.

16. A bottom hole assembly for performing an operation downhole, comprising:

a hydraulic motor that has an element that rotates in response to a flow of a power fluid defining the speed of the hydraulic motor;

a downhole tool; and a control valve for controlling the speed of the hydraulic motor by directing working fluid through the bottom hole assembly, the control valve coupled to the motor and having a valve housing having a housing port, a valve piston having a valve piston port, the valve piston and valve housing being moveably connectable to one another and adapted to establish a bypass flow when the valve housing and valve piston ports are at least partially aligned; and a pump assembly coupled to the valve and adapted the selectively increase the bypass flow when the motor speed is above a predetermined speed and to selectively decrease the bypass flow when the motor speed is below the predetermined speed.

17. The bottom hole assembly of claim 16 in which the bypass flow is proportional to the motor speed.

18. The bottom hole assembly of claim 16 in which the hydraulic motor is a mud motor and the element is a rotor.

19. The bottom hole assembly of claim 18 in which the downhole tool is a drill bit.

20. The bottom hole assembly of claim 16 in which the hydraulic motor is a turbine and the element is a turbine shaft.

21. The bottom hole assembly of claim 20 in which the downhole tool is a de-scaling unit.

22. The bottom hole assembly of claim 21 in which the pump assembly further comprises:

a pump shaft; and a pump rotatable relative to the pump shaft, the pump adapted to pump a control fluid at a rate proportional to the speed of rotation of the turbine shaft, through a control fluid system to cause relative movement between the valve piston and valve housing.

23. The bottom hole assembly of claim 22 further comprising a magnetic coupling having a male and female portion, the male portion being attached to the pump shaft, the female portion circumscribing the male portion and attached to an upper bearing housing within an outer valve housing, the male and female portions of the magnetic coupling adapted to provide relative rotational motion therebetween.

24. The bottom hole assembly of claim 23 further comprising a pair of thrust bearings, one above the flow control valve and one below the flow control valve.

25. A method of controlling the rotation of a downhole tool, comprising:

attaching a downhole tool to a hydraulic motor, the motor having a rotating element that rotates in response to a flow of power fluid;

providing a flow control valve having a valve housing and a valve piston, the valve coupled to the hydraulic motor, the valve housing having a valve housing port therethrough, the valve piston having a valve piston port, the valve housing and valve piston moveable relative to one another and adapted to establish a bypass flow when the valve housing and valve piston ports are at least partially aligned; and a pump assembly coupled to the valve and adapted to move either the valve housing or the valve piston in response to the speed of rotation of the rotating element such that the bypass flow of the working fluid through the housing and piston ports is dependent on the speed of rotation of the element; and injecting a flow of working fluid above the valve, the valve dividing the flow of working fluid flow between the flow of power fluid and the bypass flow proportional to the speed of rotation of the element.

26. The method of claim 25, further comprising providing a turbine having a turbine shaft the rotates at a speed in response to a flow of power fluid, and attaching the downhole tool to the turbine.

27. A control valve for a hydraulic motor rotating at a speed in response to a power fluid, comprising:

a valve having a valve housing and a valve piston, the valve coupled to the hydraulic motor, the valve housing having a valve housing port therethrough, the valve piston having a valve piston port, the valve housing and valve piston moveable relative to one another and adapted to establish a bypass flow when the valve housing and valve piston ports are at least partially aligned; and an energizer coupled to the valve and adapted to move either the valve housing or the valve piston in response to the motor speed such that the bypass flow of the working fluid through the housing and piston ports is dependent on the motor speed.

28. The valve of claim 27 in which the bypass flow is reduced when the hydraulic motor speed is below a predetennined speed, and the bypass flow of the working fluid is increased when the motor speed is above the predetermined speed.

29. The control valve of claim 28 wherein the bypass flow is proportional to the motor speed up to a maximum bypass flow.

30. The control valve of claim 29 wherein the energizer is a pump assembly, the hydraulic motor is a turbine, and the rotating element is a turbine shaft.

31. The control valve of claim 30 in which the pump assembly further comprises:

a pump shaft; and a pump rotatable relative to the pump shaft, the pump adapted to pump control fluid at a rate proportional to the speed of rotation of the turbine shaft, through a control fluid system to cause relative movement between the valve piston and valve housing.

* * * * *